United States Patent [19]

Waldecker

[11] Patent Number: 4,909,496

[45] Date of Patent: Mar. 20, 1990

[54] MASTER CYLINDER HOLDING FIXTURE AND METHOD OF USING SAME

[76] Inventor: Donald E. Waldecker, Suite 320, 8315 Lee Hwy., Fairfax, Va. 22031

[21] Appl. No.: 233,460

[22] Filed: Aug. 18, 1988

Related U.S. Application Data

[63] Continuation-in-part of Ser. No. 875,010, Jun. 16, 1986.

[51] Int. Cl.[4] ..... B25B 1/24

[52] U.S. Cl. ..... 269/277; 248/207; 269/256; 269/296

[58] Field of Search ..... 269/95, 256, 282, 277, 269/296, 900; 248/207, 295.1, 298, 558

[56] References Cited

U.S. PATENT DOCUMENTS

| | | | |
|---|---|---|---|
| 1,050,395 | 1/1913 | Schleicher | 248/298 |
| 1,100,822 | 6/1914 | Gordon | 411/337 |
| 1,543,454 | 6/1925 | Sparks | 248/298 |
| 1,543,455 | 6/1925 | Sparks | 248/298 |
| 2,335,896 | 12/1943 | Anderson | 248/295.1 |
| 2,427,365 | 9/1947 | Meister | 269/277 |
| 4,033,531 | 7/1977 | Levine | 248/676 |

*Primary Examiner*—Judy Hartman
*Attorney, Agent, or Firm*—Glenn E. Wise

[57] ABSTRACT

An adjustable device for rigidly holding any one of several different types of automotive hydraulic system master cylinders during assembly, disassembly, testing, maintenance, bleeding, and repair procedures, and a method of using same is described. A drip pan is provided to catch drips emanating from a master cylinder being held, if desired.

25 Claims, 3 Drawing Sheets

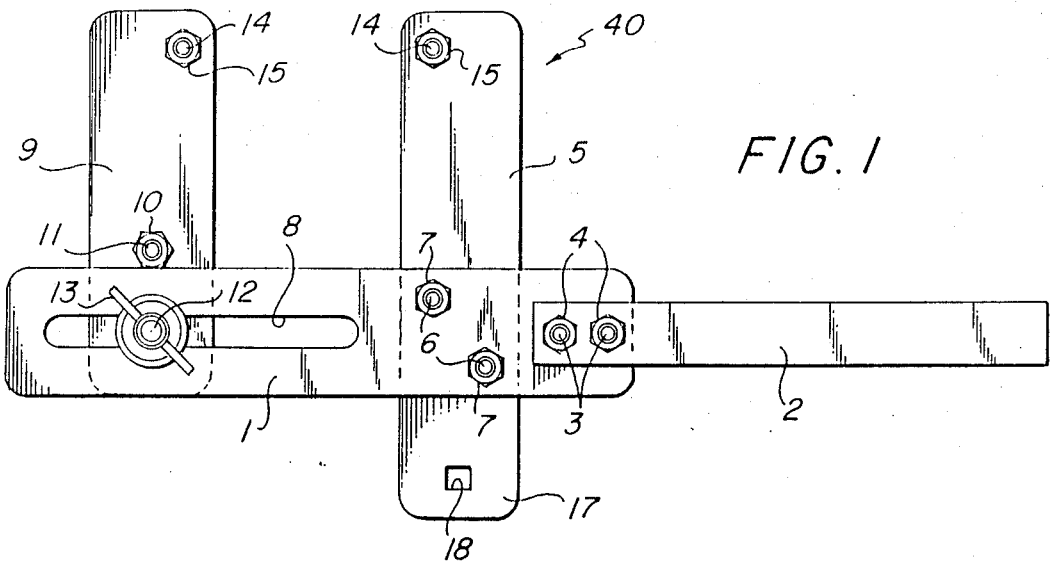
FIG. 1
FIG. 2
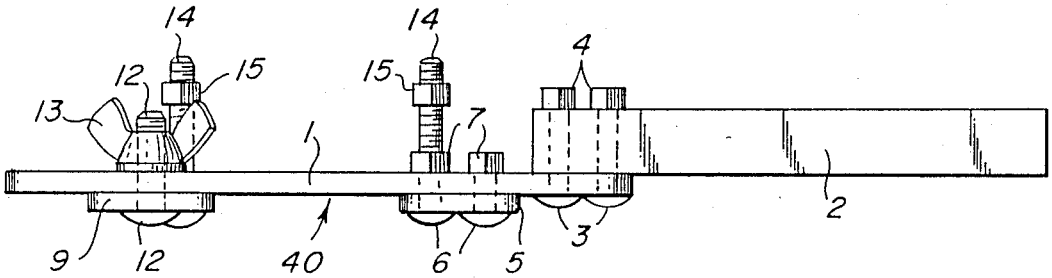
FIG. 3
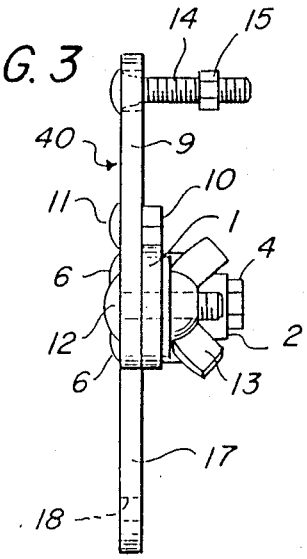
FIG. 4
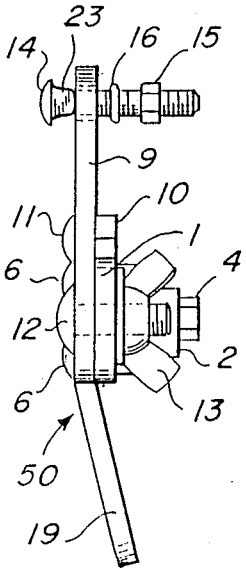
FIG. 5
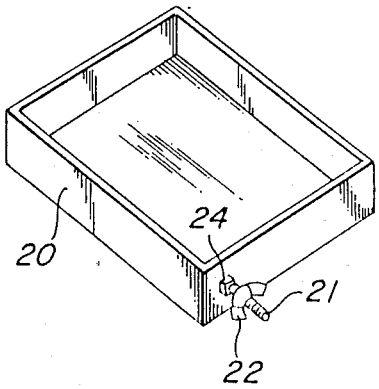

FIG. 6
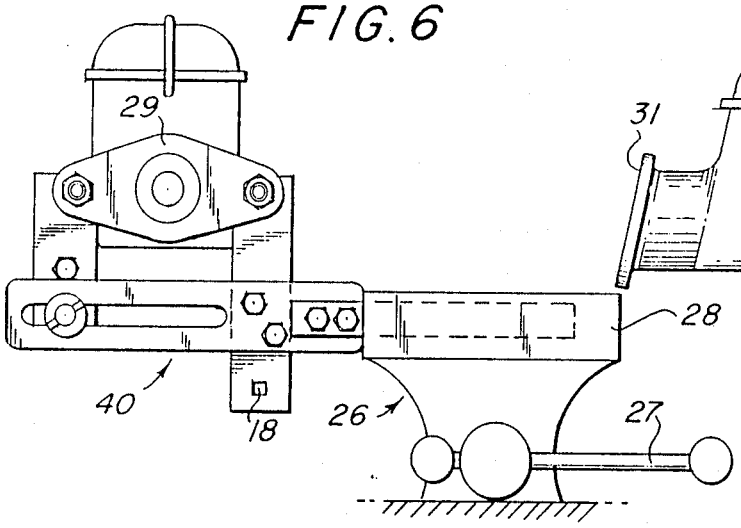
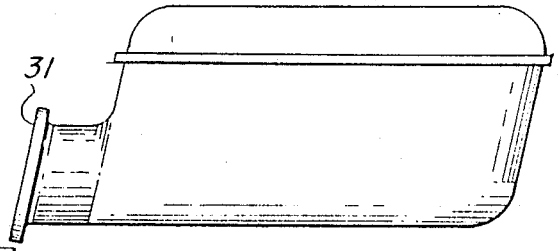
FIG. 11
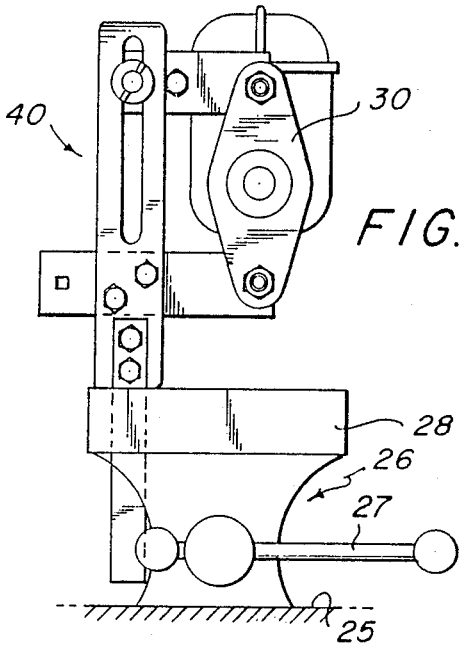
FIG. 7
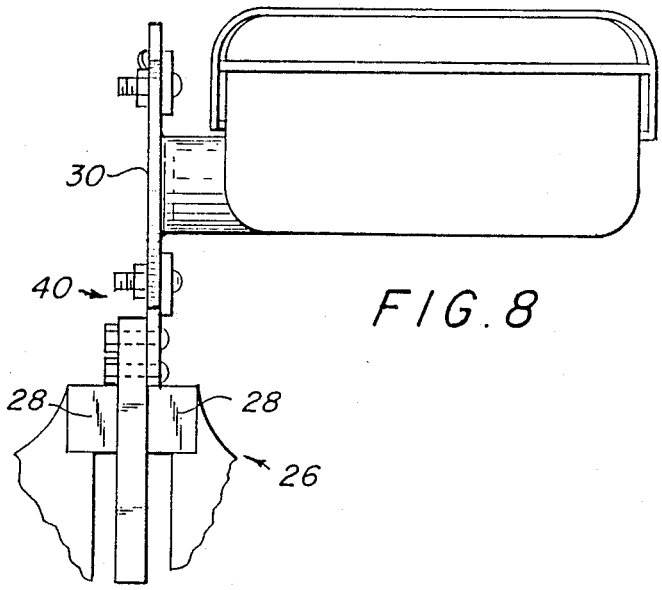
FIG. 8
FIG. 9
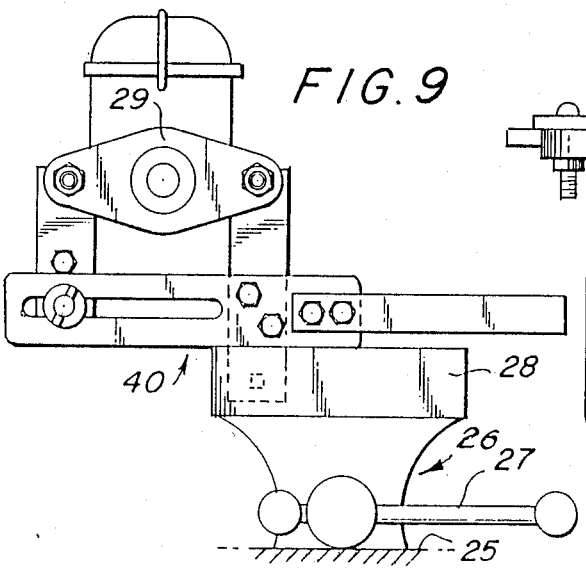
FIG. 10
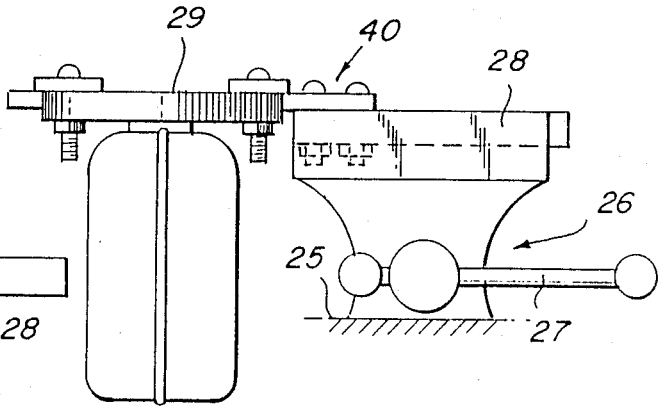

FIG. 13
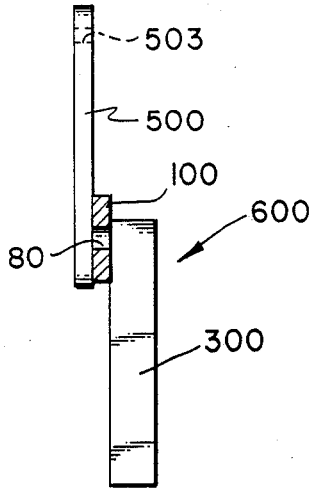
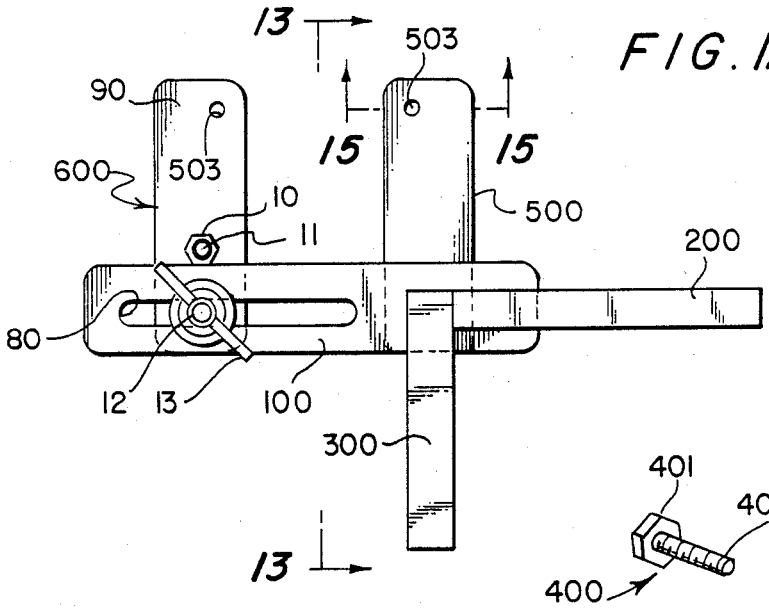
FIG. 12
FIG. 14
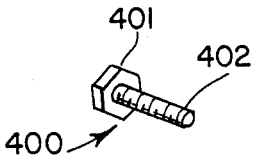
FIG. 20
FIG. 17
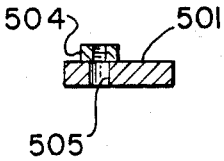
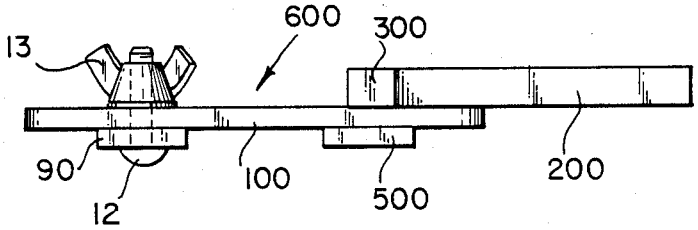
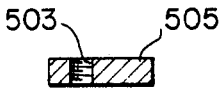
FIG. 15
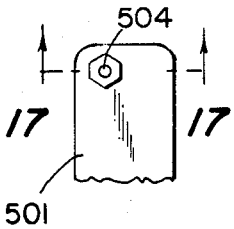
FIG. 16
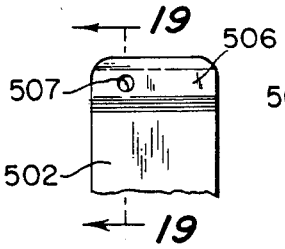
FIG. 18
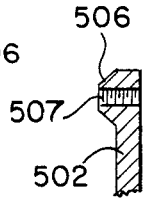
FIG. 19
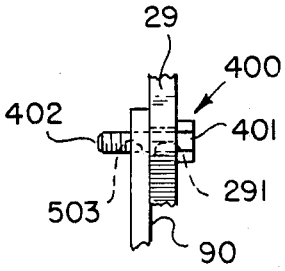
FIG. 21
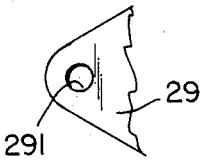
FIG. 23
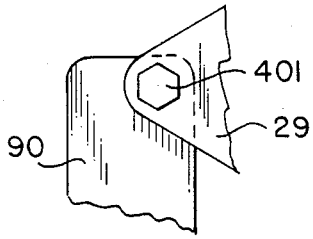
FIG. 22

MASTER CYLINDER HOLDING FIXTURE AND METHOD OF USING SAME

CROSS REFERENCE TO RELATED APPLICATION

This application is a continuation-in-part of the copending application of the same inventor, namely Ser. No. 875,010, filed June 16, 1986, and entitled "MASTER CYLINDER HOLDING FIXTURE AND METHOD OF USING SAME" now abandoned.

FIELD OF THE INVENTION

This invention relates to a work holding device or fixture, and to a method of using same, and more particularly, to an adjustable master cylinder holding fixture adapted to be mounted in a plurality of different orientations in the jaws of a vise and to hold automotive brake system master cylinders during work such as maintenance, testing and repair of such items.

In the maintenance, testing and repair of certain items such as automotive brake system master cylinders, it is often desirable to remove such items from their operational mounting on a vehicle and to work on them away from the vehicle, for example, at a work bench. The flanged type of mountings usually provided for these items, however, may render direct vise mounting during bench work difficulty because of the shape or location of such mountings, or innapropriate because the items cannot be oriented as desired for the work thereon if directly vise mounted. Also, because the construction of such items, for example, as a die casting, is sometimes not designed sufficiently strong to be safely vise-mounted. Thus, I have recognized the desirability of having available a fixture for holding a master cylinder at a work bench during work thereon and present herein my invention which provides such a fixture, and a method of using same, herein after.

DESCRIPTION OF PRIOR ART

Jigs or fixtures for holding various articles during work thereon have been broadly known for a long time. By way of example, the following U.S. patents are noted: Nos. 4,140,306, 3,048,387 and 3,083,004 which relate to fixtures for holding cylinder heads; No. 2,306,461 for holding vacuum pumps; No. 2,568,508 for holding engine blocks; and 4,307,877 for holding automatic transmissions. All of these six patents just listed exhibit various adjustment features useful in mounting the articles they are intended to hold. However, none of these patented devices is for my specific purposes or provides a structure like my fixture capable of performing the functions my fixture does.

SUMMARY OF THE INVENTION

One object of the invention is to provide a fixture for holding a master cylinder stationary and in a convenient orientation so that a mechanic can work on the master cylinder including the internal parts thereof.

Another object is to provide a master cylinder holding fixture which is adjustable so that the fixture can be used to hold master cylinders having different mounting bolt hole spacings.

A still further object is to provide a fixture which can firmly hold in a variety of orientations master cylinders having either horizontally or vertically elongated mounting flanges.

Another object of the invention is to provide means in a master cylinder holding fixture for allowing stationary mounting for master cylinders having flange mountings either perpendicular or angled relative to their longitudinal axes so that either type of master cylinder can be rigidly mounted on the fixture with their fluid reservoirs oriented substantially level.

A further object of the invention is to provide a drip-catching pan attachment for my fixture which may be used during fluid filling, draining, bleeding, and testing of master cylinders, if desired.

Another object is to set forth a method of using my fixture. Other objects will be evident from the following detailed description when viewed in conjunction with the accompanying drawings which show preferred and alternate embodiments of my invention and describe a method of using them.

BRIEF DESCRIPTION OF THE DRAWINGS

In the drawings which form a part of this application:

FIG. 1 is a plan view of a first embodiment of my master cylinder holding fixture.

FIG. 2 is a front elevational view from the structure shown in FIG. 1.

FIG. 3 is an elevational view taken from the left side of FIG. 1.

FIG. 4 is a view similar to FIG. 3, but showing an alternate construction useful for stationarily mounting master cylinders having angled or off-vertical flange mountings such that these master cylinders' reservoirs are oriented substantially level.

FIG. 5 is a drip catching pan which can be rigidly attached to and is designed for use with the embodiment shown in FIGS. 1, 2, and 3.

FIGS. 6 through 10 show various exemplary ways that the fixture of FIGS. 1, 2, and 3 can be clamped in a bench vise to rigidly support different types of master cylinders, having either vertically or horizontally extending mounting-hole-including flanged mounting plates, in various orientations so that work can be conveniently performed on them.

FIG. 11 shows schematically a side view of a type of master cylinder wherein the flanged mounting plate is angled relative to the longitudinal axis of such cylinder as opposed to the master cylinders in FIGS. 6 through 10 wherein the flanged mounting plate is generally perpendicular to the longitudinal axis of the master cylinders shown.

FIG. 12 is a vertical elevation, with parts unnecessary to a description thereof removed, of a modification of the structure of FIGS. 1 to 3.

FIG. 13 is a vertical sectional view taken on the line 13—13 in FIG. 12.

FIG. 14 is a bottom plan view of the structure of FIG. 12.

FIG. 15 is a cross-sectional view taken on the line 15—15 in FIG. 12.

FIG. 16 is a vertical elevational view showing an alternate construction of the tops of the element crossed by section line 15—15 in FIG. 12.

FIG. 17 is a somewhat enlarged cross-sectional view taken on the line 17—17 in FIG. 16.

FIG. 18 is a vertical elevational view showing a further alternate construction of the top of the element crossed by section line 15—15 in FIG. 12.

FIG. 19 is a cross-sectional view taken on the line 19—19 of FIG. 18.

FIG. 20 is an isometric view of a conventional hex-head bolt used with any of the constructions illustrated in FIGS. 12 through 19.

FIG. 21 is an elevational view taken from the left-hand side of the top of element 90 in FIG. 12 showing how the bolt of FIG. 20 is used to clamp the apertured flange 29 of a flange-mounted item such as a master cylinder to the embodiment of my fixture illustrated in FIGS. 12 to 14.

FIG. 22 shows a portion of apertured flange 29 by itself.

FIG. 23 is a somewhat enlarged elevational view taken from the right-hand side of FIG. 21.

DETAILED DESCRIPTION OF THE PREFERRED EMBODIMENTS

In the drawings, reference numerals have been employed to indicate parts as follows: main support bar 1; support bar vise clamping stem 2; fastening bolts 3; fastening nuts 4; fixed part mounting leg 5; fastening bolts 6; fastening nuts 7; slot 8 in main support bar 1; adjustable part mounting leg 9; guide nut 10; guide nut mounting bolt 11; adjustment bolt 12; wing-type adjustment nut 13; part mounting bolts 14; part fastening nuts 15; O-ring bolt retainer 16; straight vise clamping portion 17 of fixed part mounting leg 5; drip pan supporting aperture 18 in straight vise clamping portion 17; angle-type vise clamping extension 19 on fixed part mounting leg 5; drip catching pan 20; drip catching pan mounting stud 21; wing nut 22; frusto-pyramidal, square cross-sectioned bolt shank portion 23; square stud shank portion 24; fixed support 25; conventional screw actuated, expandable and contractable opposed jaw-type bench vise 26; vise adjusting handle 27; vise jaws 28; master cylinder with laterally extending apertured wing-type vertically oriented mounting flange 29; master cylinder with vertically extending apertured wing-type vertically oriented mounting flange 30; and, master cylinder with laterally extending apertured wing-type off-vertical mounting flange 31.

In addition, the first embodiment of my invention has been designated generally as 40, one alternate construction or embodiment has been designated generally as 50, and another alternate construction or embodiment has been designated generally as 600.

More specifically, in FIGS. 1 to 10 of the drawings main support bar 1 is rigidly attached to the support bar vise clamping stem 2 by way of bolts 3 which pass through aligned holes provided for them in elements 1 and 2, such bolts cooperating in their fastening function with fastening nuts 4 which are turned down tightly against stem 2. Although it is not necessary, it is desirable that all of the bolts used in the FIGS. 1 to 10 embodiments of may fixture be of carriage type wherein a short square, in lateral cross-section, frusto-pyramidal portion, as at 23 in FIG. 4, forms the shank of the bolt immediately adjacent the shank-attaching side of the bolt head. Further, it is desirable that the apertures in which the square cross-sectioned bolt portions in these embodiments reside also be of square cross section and be designed to snugly receive the largest cross-section of the square pyramidic bolt portions so that the bolts cannot turn relative to their receive apertures once they are properly installed.

Located closely adjacent to the fixed end of stem 2 and also fastened to bar 1 is a fixed part mounting leg 5. Leg 5 is oriented perpendicularly to bar 1 and rigidly fastened thereto by way of fastening bolts 6 which pass through aligned holes provided for them in elements 1 and 5, and are held by nuts 7.

Between fixed leg 5 and the free end of bar 1 is located an adjustable part mounting leg 9 which engages a slotted portion of bar 1. The slot in bar 1 is designated 8.

Stationarily affixed to leg 9 by means of guide nut mounting bolt 11 passing through an aperture provided in leg 9 is a fixed guide nut 10, one edge of which engages and tracks along one edge of bar 1 when leg 9 is adjusted relative to leg 5, as will be further described.

To maintain guide nut 10 is engagement with the edge of bar 1 and to allow for adjustment of let 9 along bar 1 there are provided manually manipulatable fastening means consisting of adjustment bolt 12 and wing-type adjusting nut 13. The shank portion of bolt 12 adjacent the head of such bolt, which is preferably of square cross section as previously described, is snugly located in a square aperture provided thereof in leg 9, and the shank extends on through slot 8 and through nut 13.

When nut 13 is loosened, leg 9 may be moved along bar 1 within the limits of bolt 12 engaging the opposite ends of slot 8. When nut 13 is tightened down against bar 1, leg 9 is stationarily fixed to bar 1.

Both legs 5 and 9 carry at contiguous ones of their ends part mounting bolts 14. Preferably, each of such bolts 14 has a square shank portion snugly located in a square aperture in the leg in which it is mounted.

To impede bolts 14 from becoming separated form their respective legs in normal use, a snugly fitting O-ring such as 16 in FIG. 4 may be provided. Bolt 14 and O-ring 16 in FIG. 4 are displaced from the positions they would normally occupy, for the purposes of illustration. In normal use, the flat side of the bolt head of bolt 14 would be in engagement with the left side of leg 9 and the O-ring would be in engagement either with the right flat side of leg 9 as such side is shown in FIG. 4, or the O-ring on each leg would be located in a countersink (not shown) provided for it in the side of each leg that the free end of each bolt 14 is on. O-ring 16 is elastic.

To retain master cylinders mounted on bolts 14 rigidly and securely in place, as will be further discussed hereafter, part fastening nuts 15, as shown, are provided.

In use, the preferred embodiment of my device, which is designated generally by 40, is supported either by having its mounting stem 2, or a straight vise-clamping portion 17 of fixed part mounting leg 5, clamped between the jaws of a conventional screw-actuated, expansible and contractable, opposed-jaw-type bench vise such as designated generally as 26 which vise is schematically illustrated and shown in rigidly mounted to a fixed support 25, such as a work bench, by means not shown, in FIGS. 6, 7, 9, and 10.

The numeral 18 designates a drip-catching pan supporting square aperture in straight vise clamping portion 17. Such aperture 18 is intended, when a user desires to use the drip-catching pan 20, to non-rotatably receive the square stud shank portion 24 of the drip-catching pan mounting stud 21 which is attached at one of its ends to one end of the drip-catching pan 20. For example, if one wished to use my drip-catching pan 20 with my fixture 40 as it is shown mounted in vise 26 in FIG. 6, and have such pan be under a supported master cylinder, it would first be necessary to remove wing nut 22 from pan mounting stud 21 and with the open top of the pan upward to then enter stud 21 into the near end of aperture 18 as viewed in FIG. 6 and then replace nut 22 on the free end of stud 21 and tighten such nut up against the back side of fixed leg 5 whereby square stud shank portion 24 of stud 21 is snugly and non-rotatably located in aperture 18. Since pan 20 is thereby supported extending from my fixture 40 in cantilever fashion toward the viewer, it would be necessary, if the master cylinder now shown mounted in FIG. 6 was to be supported directly above pan 20, to detach such master cylinder, reorient it 180 so that its long dimension was also extending in cantilever fashion toward the viewer and re-attach it to fixture 40 by means of bolts 14 and nuts 15 such that the presently viewable face of flange 29 in FIG. 6 would then be reversed and in engagement with the front faces of the tops of legs 5 and 9.

FIG. 4 shows a second embodiment of my fixture which is designated generally as 50. Fixture 50 differs from fixture 40 only in that the vise-clamping portion 19 of the fixed part mounting leg 9 is inclined or angled relative to the remainder of leg 9 rather than co-lineal with leg 9 as in fixture 40. Portion 19 is provided so that master cylinders having angled bodies or flanges such as at 31 in FIG. 11 can be supported on my fixture 50 with their main body portions, which contain their liquid reservoirs, substantially level. This is accomplished by clamping portion 19 of fixture 50 between vise jaws 28 in the same way that portion 17 fixture 40 is shown clamped in FIG. 9. Such clamping of portion 19 would cause the top portion of leg 9 and all of leg 5 to slant upwardly and forwardly toward the viewer. If the free, i.e., the left hand, face of flange 31 in FIG. 11 is then engaged with and bolted to the front face of the tops of the legs 5 and 9 of fixture 50 by using bolts 14 and nuts 15, then the body portion of the master cylinder adjacent flange 31 including its fluid reservoir will be substantially level since the angularity of slope of 19 is designed relative to the angularity or slope of flange 31 to achieve this. Such substantially level mounting not only of the FIG. 11 type of master cylinder but also of the other types of reservoirs depicted is desirable under those circumstances when hydraulic fluid is still contained in a master cylinder supported on one of the embodiments of my devices so that hydraulic fluid is not spilled unnecessarily during work on such master cylinder, especially if the master cylinder's cap is removed and if the drip catching pan is not installed under such a fluid-containing master cylinder.

The general utility and method of using the FIGS. 1 to 10 embodiments of my device to provide a stable and rigid mounting for master cylinders during work on them is now believed to have been demonstrated. Also, one particular method of using fixture 50 has been described. FIGS. 6 to 10 show other exemplary ways my fixture 40 embodiment can be used to support master cylinders in various orientations. Since stem 2 has four flat sides, it will be apparent that both the FIG. 6 and FIG. 7 mountings can be changed to achieve other possibly desirable orientations of a supported master cylinder relative to its supporting vise for particular work operations by loosening the vise jaws, rotating the stem 2 in place by 90° or 180° or 270°, as desired, and retightening such jaws. Other possible orientations of my fixtures relative to a supporting vise will be apparent from a study of the drawings.

It will be apparent from viewing FIGS. 6 to 10 that the master cylinders depicted therein can be mounted on my fixtures either with legs 5 and 9 between their mounting flanges and their main body portions (as in FIGS. 6 to 9) or (as in FIG. 10) with the face of flange 29 opposite the face attached to the master cylinder's main body portion engaging legs 5 and 9.

FIGS. 12, 13, and 14 are presented to illustrate another embodiment of my invention. Main support bar 100 with its slot 80 in FIG. 12 is very similar to main support bar 1 in FIGS. 1, 2, and 3, except that bar 100 is not provided with the four apertures in bar 1 through which bolts 3 and 6 pass. Elements 90 and 500 in FIGS. 12, 13 and 14 are, respectively, adjustable and fixed part mounting legs akin to somewhat similar legs 9 and 5 in FIGS. 1 to 3. Elements 10, 11, 12 and 13 seen in the embodiment of FIGS. 1 to 3 are also used with elements 90 and 100 in the embodiment of FIGS. 12 to 14 exactly as shown and described relative to elements 9 and 1 in FIGS. 1 to 3.

Fixed part mounting leg 500 is welded to main support bar 100 by weldments not shown. Vise clamping stem 200 and vise clamping portion 300 are also welded to bar 100 by weldments not shown, as well as being welded to each other, is desired. Whereas fixed part mounting leg 5 of FIGS. 1 to 3 extends below bar 1 to provide straight vise clamping portion 17, fixed part mounting leg 500 of FIGS. 12 to 14 extends only to the bottom of bar 100, and as just described, whereas leg 5 was bolted to bar 1 in the embodiment of FIGS. 1 to 3, leg 500 is welded to bar 100.

The vise clamping capabilities provided by portion 17 in the embodiment of FIGS. 1 to 3 are provided and expanded in the embodiment of FIGS. 12, 13, and 14 by vise clamping portion 300. Portion 300, being thicker in cross-section than portion 17, and in fact, being substantially or actually square in cross-section, provides two more reliable clamping surfaces beyond the reliable clamping surfaces provided by portion 17. This is because it has been found that if a user clamps portion 17 of the fixture as shown in FIGS. 1 to 3 in a bench vise in such fashion that the axis of aperture 18 is parallel to and between the clamping faces of the two vise jaws, then only a modest torquing force applied to leg 5 in the normal course of using the fixture of FIGS. 1 to 3 may cause such fixtures to twist out of vise jaws. On the other hand, with portion 300 of the fixture of FIGS. 12 to 14, each of its four longitudinally extending vise jaw engagable surface is sufficiently broad that no such twist out, as described relative to portion 17 occurs. Thus both support bar vise clamping stem 200, to be further described but similar in function and structure to support bar vise clamping stem 2, and portion 300 can be reliably clamped between the opposed jaws of a bench vise, such as jaws 28, no matter which of their opposite longitudinally extending surfaces are chosen to be engaged by and clamped between a pair of bench vise jaws at a given time.

Clamping stem 200, it will be noted, is also substantially square in cross-section like stem 2, but sem 200 extends to, engages, and may be welded to the top of portion 300 thereby adding rigidity to the structure composed of elements 100, 200, and 300.

While it is also possible to utilize elements 14 and 15 with the embodiment of FIGS. 12 through 14 merely by providing the same kind of bolt receiving apertures in legs 90 and 500 for receiving a bolt 14 as has previously been described in legs 9 and 5, it has been found desirable, in some instances to reduce the number of removable parts in my fixture, such that parts are less likely to be lost or temporarily misplaced, by in effect, "building in" the nut capabilities provided by nuts 15. Thus, in FIGS. 12 through 15, in lieu of nuts 15 being associated with each part mounting leg 90 and 500, threatened apertures are provided in legs 90 and 500 to mate with the complimentary threaded shanks 402 of conventional hex-headed bolts, one of which is shown and designated generally at 400 in FIG. 20. While bolt 400 is shown as having a hex-head 401, other types of heads, for example, square can also be used.

FIGS. 16 to 19 show other ways of modifying legs 90 and 500, if desired, such that a user of my fixture need not be concerned with nuts going astray. Specifically, in FIGS. 16 and 17 wherein the numeral 501 is used to represent modified leg 500 and wherein leg 90 would also be modified in like fashion to form a mirror image of the top of leg 501, instead of providing threaded apertures 503 in the tops of each of legs 90 and 500, unthreaded round apertues 505, larger in diameter than shanks 402, are provided. Adjacent and coaxial with each aperture 505 are welded to the tops of leg 501 and its mirror image, by welding not shown, conventional hex-nuts 504 which are each sized to mate with a bolt 400, when a user desires. Since enlarged apertures 505 are coaxial with nuts 504, a bolt can be easily threaded into a nut 504 from either side.

In the final modification shown in FIGS. 18 and 19 herein the numeral 502 is used to represent modified leg 500 and wherein leg 90 would also be modified in like fashion to form a mirror image of the top of leg 502, the top of leg 502 and the top of its mirror image are each thickened as shown at 506 and such thickened portions are each provided with a threaded apertures 507 sized to mate, when a user desires, with bolt 400. The thickenings 506, by providing more thread length in threaded apertures 507, provide insurance against thread stripping in such apertures.

FIGS. 21 to 23 are presented to illustrate how one end of a typical apertured flange of a flange-including article of the type of my invention is designed to hold may be held by the fixture of the embodiment shown in FIGS. 12 through 15. More specifically, FIG. 23 shows a portion of a flange 29 of such a flange-including article, such flange having an aperture 291. FIGS. 21 and 22 show the flange portion 29 of FIG. 23 supported and tightly held by one part mounting leg for which illustrative purposes leg 90 has been chosen whereby the reader can gain a fuller mental picture of use environment by comparing FIG. 22 with the relationship of flange 29 to leg 9 in FIGS. 6 and 9. FIG. 21 illustrates that since aperture 503 of leg 90 is now threaded and sized to mate with the threads on bolt 400, nuts for the purpose fulfilled by nuts 15 in the embodiments of FIGS. 1 through 10 are no longer required since flange 29 can be tightly held between a leg such as 90 and the head 401 of a bolt 400 without such nuts.

While drawing figures similar to FIGS. 21 and 22 could also be presented to illustrate how an apertured flange such as flange 29, of an apertured flange-including article, may be supported and tightly held by the two alternate structures illustrated in FIGS. 16, 17 and 18, 19, respectively, such additional figures are not considered to be necessary since it is believed that a mechanic would readily understand, based on the teachings already presented in FIGS. 21 to 23, how bolts 400 can be used in cooperation with nut 504 and threaded aperture 507 when used to desired support and tightly hold such flanges. Also, although but a single parts mounting leg is shown for illustrative purposes in each of the alternate structures depicted by FIGS. 16, 17, and 18, 19 and 21, 22, respectively, it is to be understood that two legs 90 and 500, or 501 and its mirror image, or 502 and its mirror image and two cooperating bolts for whichever of the three alternate structures is chosen are to be used whenever an apertured flange-including articles is being supported and held.

FIGS. 6 through 10 will also serve to suggest some of the various ways that the embodiments of my fixture shown in FIGS. 12 through 22 can be clamped between a pair of vise jaws 28. Other orientations for supporting these last mentioned embodiments relative to a pair of vise jaws, including the orientations already specifically discussed relative to portion 300, will be readily apparent to a mechanic.

Although my fixtures were designed and have been described as being used for holding master cylinders, it will be apparent that such fixtures can be used to hold, during work thereon, many other items which have apertured flange-type mountings similar to those illustrated. Automotive fuel pumps and carburetors are mentioned by way of illustration.

Also some master cylinders and other flange-mounted articles or items have other than two fastener receiving apertures in their mounting flanges such as the four apertures seen at 60 in the flange 58 of U.S. Pat. No. 3,040,886. It will be apparent, for example, that by loosening wing nut 13 and appropriately adjusting bolt 12 (and thus leg 9) along and within the dimensional limits of slot 8 as required, as regards the embodiment of FIGS. 1 to 3, a great many different apertured flange-mounted articles having various aperture spacings and numbers of apertures, preferably two or more, can be rigidly mounted. The embodiment of FIG. 4, and the embodiments of FIGS. 12 through 22 can be adjusted in the same manner so as to be capable of supporting various apertured flanged articles.

It is desirable, when using any of my fixtures 40, 50, or 600 to engage the facing portions of the vise jaws not only with the stem 2 or 200, or vise clamping portions 17, 19, or 300 (depending upon which of elements 2, 200, 17, 19, or 300 it is desired to clamp between jaws 28), but also to have another portion of fixture 40, fixture 50, or fixture 600 (depending upon which fixture is being used at a given time) squarely abutt at least one other face on one or more of the vise jaws beside the clamping faces. Thus, in FIGS. 7 and 8 the stem-attached end of main support bar 1 is shown to be squarely abutting the top of one vise jaw 28. FIGS. 6, 9 and 10 show other examples of abutments of non-jaw-clamped portions of my fixture. The method of mounting, as just described, increases the stability and rigidity achievable by depending solely on clamping of element 2 or 200 or 17 or 300 or 19.

It is also desirable to interlock elements 3 to elements 4; elements 6 to elements 7 and element 10 to element 11 once the just-described elements have been properly assembled and tightened in my device, as shown. Such interlock can be achieved by various means as is generally well known, for example, by burring the threads on either the nuts or bolts, or both, by welding or brazing the nuts to the bolts, and by the use of lock nuts. When assembled, my fixtures, as will be most evident from FIGS. 7 and 12, respectively, have the general appearance of the letter F, or of a distorted numeral 4.

Since each of my fixtures is designed to cooperate with a conventional bench vise in such fashion that the vise, in effect, becomes the fixed base of a fixture, it is not necessary to otherwise furnish such a base for each fixture. I thereby take advantage of the fact that such vises are widely available to utilize them with my fixtures as indicated herein thereby saving the cost of providing a built-in base for each of my fixtures.

The foregoing is considered illustrative only of the invention. Since numerous modifications and changes will readily occur to those skilled in the art, it is not desired to limit the invention to the exact construction and operation shown and described, and, accordingly, all suitable modifications and equivalents which fall within the scope of the invention may be resorted to.

Having described my invention, what I claim as new and desire to secure by Letters Patent is as follows:

1. A fixture adapted to temporarily and firmly hold a given flange-mounted item while work is being performed thereon, said flange-mounted item including at least two spaced apertures through which fastening elements pass when said item is held in its position of use, comprising: an elongated main support, a first elongated substantially square solid portion rigid with said main support adapted to be firmly clamped between the jaws of a stationarily mounted conventional opposed and adjustable jaw bench vise; a first item-mounting leg attached to and extending substantially perpendicularly from said main support and terminating in free end; a second item mounting leg attached to and extending substantially perpendicularly from said main support in the same direction as and substantially parallel to said first said leg and terminating in a free end; said main support, said first portion, and said first and second item-mounting legs all having their longitudinal axes oriented parallel to a first imaginary plane; fastener means on the free end of each leg adapted to interact with different portions of the flange of said given item to hold said given item rigid relative to said fixture and, thus, relative to said vise when said first portion is firmly clamped between said jaws, said fastener means each including a fastening element located so as to pass through a different one of said spaced apertures when said given item is being held; means for rendering one of said legs adjustable along the length of said main support and means for re-orienting a workpiece including an additional elongated solid portion attached to said main support for providing an alternate vise clamping location, said additional portion extending from said main support in a direction generally opposite from the direction in which said item mounting legs extend.

2. The fixture of claim 1 including means on said one leg cooperating with said main support to maintain said legs substantially parallel during and after adjustment of said one leg.

3. The fixture of claim 2, said rendering means comprising a cooperating nut and bolt, said bolt being located in an elongated slot in said main support.

4. The fixture of claim 1, each element comprising a bolt.

5. The fixture of claim 1, said first portion having one end attached to one of the ends of the main support, extending perpendicular to said main support, and terminating in a free opposite end.

6. The fixture of claim 1, said first portion rigid with said main support having one end attached to one of the ends of the main support, extending parallel to said main support, and terminating in a free opposite end.

7. The fixture of claim 1, said main support including separate surfaces forming separate abutment means adjacent said first portion and said additional portion, respectively, one of said separate abutment means being adapted to engage a portion of at least one of said vise jaws other than a clamping face of said one jaw when either of said first portion or said additional portion is clamped between the jaws of said vise.

8. The fixture of claim 1, said fastener means each comprising cooperating threaded means, and each element comprising a bolt.

9. The fixture of claim 8, each bolt including a shank located in an aperture in the leg with which it is associated.

10. The fixture of claim 9, each bolt including means cooperable with means on the leg with which it is associated to prevent each bolt from rotating relative to its leg when desired.

11. The fixture of claim 8 said fastener means comprising female threads each including a threaded aperture in one of said legs.

12. The fixture of claim 11, each threaded aperture being located in an enlargement adjacent a free end of the leg in which it is located.

13. The fixture of claim 8, said means fastener comprising female threads each including a nut rigidly fastened to one of said legs.

14. The fixture of claim 13 further including an aperture in each leg coaxial with each nut, each coaxial aperture having a diameter large enough to allow one of said bolts to easily pass therethrough.

15. The fixture of claim 8, said means fastener comprising female threads each including an independent threaded nut adapted to be threadedly engaged with its respective bolt.

16. The fixture of claim 1, said main support having a surface forming abutment means adjacent said first portion; said abutment means being adapted to engage a portion of at least one of said vise jaws other than a clamping face of said one jaw when said first portion is firmly clamped between the jaws of said vise.

17. The fixture of claim 1, the longitudinal axis of said additional portion also being oriented parallel to said first imaginary plane, and said additional portion also being substantially square.

18. The fixture of claim 1, said additional portion attached to said main support comprising an extension of one of said legs.

19. The fixture of claim 18, said extension being integral and colineal with the remainder of the leg to which it is attached.

20. The fixture of claim 18, said extension being integral with and at an angle to the remainder of the leg to which it is attached.

21. The fixture of claim 1, said additional portion extending from one of said legs and providing an alternate vise clamping location.

22. The fixture of claim 21, said additional portion being integral and colineal with the remainder of the leg from which it extends.

23. The fixture of claim 22, said additional portion being integral with and at an angle to the remainder of the leg to which it is attached.

24. The fixture of claim 21, said additional portion extending from the leg other than said adjustable leg.

25. The fixture of claim 24, said additional portion including means cooperable with means on a drip-catching pan to rigidly support said pan relative to said fixture.

* * * * *